US009846386B2

(12) United States Patent
Takasaka et al.

(10) Patent No.: US 9,846,386 B2
(45) Date of Patent: Dec. 19, 2017

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Atsushi Takasaka, Kawasaki (JP); Tadashi Horikawa, Numazu (JP); Naoya Asanuma, Susono (JP); Go Torii, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/285,274

(22) Filed: Oct. 4, 2016

(65) Prior Publication Data

US 2017/0102639 A1 Apr. 13, 2017

(30) Foreign Application Priority Data

Oct. 7, 2015 (JP) ..... 2015-199795

(51) Int. Cl.
*G03G 15/08* (2006.01)
*G03G 21/18* (2006.01)

(52) U.S. Cl.
CPC ..... *G03G 15/0881* (2013.01); *G03G 15/0882* (2013.01); *G03G 21/1814* (2013.01); *G03G 15/0886* (2013.01); *G03G 21/1832* (2013.01)

(58) Field of Classification Search
CPC ..... G03G 15/0881; G03G 21/1814; G03G 15/0882; G03G 21/1832; G03G 15/0886
USPC ..... 399/106
See application file for complete search history.

(56) References Cited

U.S. PATENT DOCUMENTS

2013/0308972 A1* 11/2013 Shindo ..... G03G 15/0882 399/106
2014/0126928 A1* 5/2014 Batori ..... G03G 15/0881 399/106
2014/0212166 A1* 7/2014 Takeuchi ..... G03G 15/0898 399/106

FOREIGN PATENT DOCUMENTS

JP 8-254888 A 10/1996
JP 2011047981 A * 3/2011
JP 2013-242442 A 12/2013
JP 2013-257540 A 12/2013
JP 2014-134708 A 7/2014
JP 2014-167606 A 9/2014
JP 2015-161867 A 9/2015

* cited by examiner

*Primary Examiner* — Billy Lactaoen
(74) *Attorney, Agent, or Firm* — Canon U.S.A., Inc. IP Division

(57) ABSTRACT

A developer container or a developing device including a sheet member having a plurality of holes and a plurality of protruded portions to be inserted into the holes.

22 Claims, 17 Drawing Sheets

DEVELOPER CONTAINER, DEVELOPING DEVICE, PROCESS CARTRIDGE, AND IMAGE FORMING APPARATUS

BACKGROUND OF THE INVENTION

Field of the Invention

An embodiment of the present invention relates to a developer container, a developing device, a process cartridge, and an image forming apparatus.

Herein, the developer container is a container that accommodates developer. The developing device is a device including at least a developer carrying member that carries developer. The process cartridge is a cartridge integrally including an image bearing member, such as an electrophotographic photosensitive drum, and a process unit that acts on the image bearing member. Examples of the process unit include a developing means, a charging unit, and a cleaning means. The process cartridge includes at least one of these elements as the process unit. In addition, the process cartridge is detachably attached to the apparatus main body of the image forming apparatus.

The image forming apparatus is an apparatus that forms an image on a recording material. Examples of the image forming apparatus include a copying machine, a printer (e.g., an LED printer and a laser beam printer), a facsimile apparatus, and a word processor.

Description of the Related Art

In electrophotographic image forming apparatuses (hereinafter, referred to as "image forming apparatuses"), as an image bearing member, an electrophotographic photosensitive member generally formed in the shape of a drum (i.e., a photosensitive drum) is evenly electrically charged. Then, the charged photosensitive drum is selectively exposed to light, thereby forming an electrostatic latent image on the photosensitive drum. Then, the electrostatic latent image formed on the photosensitive drum is developed as a toner image by using toner as developer. Thereafter, the toner image formed on the photosensitive drum is transferred onto a recording material such as a recording sheet or a plastic sheet. Further, heat or pressure is applied to the toner image that has been transferred onto the recording material to fix the toner image on the recording material. In this way, image forming apparatuses perform image recording.

In general, toner supply, and maintenance of various kinds of process units are required for such image forming apparatuses. In order to facilitate the toner supply and the maintenance of the process units, a photosensitive drum, a charging means, a developing means, and a cleaning means are integrally formed into a frame as a cartridge. Process cartridges that are attachable to and detachable from an image forming apparatus main body are in practical use.

This process cartridge system, with which users are able to do maintenance of apparatuses by themselves, can provide image forming apparatuses having improved operability and superior usability. Thus, the process cartridge system is widely employed in the field of the image forming apparatuses.

In addition, the developing means included in the aforementioned process cartridge includes a developing roller and a developing blade. The developing roller supplies toner onto the photosensitive drum. The developing blade regulates a toner layer on the developing roller. The developing means is separated into a toner chamber and a developing chamber. The toner chamber accommodates toner. In the developing chamber, the developing roller and the developing blade are arranged. The toner chamber and the developing chamber are in communication with each other via a toner supply opening.

In many cases, a toner supply opening of a new process cartridge is sealed by a toner sealing member. This is to prevent leakage of the toner in the toner chamber during distribution of the process cartridge. The toner sealing member is bonded to the toner supply opening at the periphery of the toner supply opening by heat welding or the like. There is a type of toner sealing member that is unsealed by the user when the process cartridge is used. There is another type of toner sealing member that is automatically unsealed. Japanese Patent Application Laid-Open No. 2014-134708 discusses a configuration in which a toner sealing member is automatically unsealed. According to this configuration, a rotary member in a toner chamber winds and unseals the toner sealing member.

Japanese Patent Application Laid-Open No. 2014-167606 discusses a configuration in which a rotary member that unseals a toner sealing member also serves as a toner conveyance member. According to the configuration, at least one hole is formed in the toner sealing member. This is to prevent increase in the load for pushing away surrounding toner and winding and unsealing the toner sealing member when the toner sealing member is wound and unsealed. The toner is caused to pass through the at least one hole in the toner sealing member, thereby reducing the amount of toner that the toner sealing member has to push away. This reduces the load needed to wind and unseal the toner sealing member.

However, the following problems can arise in a process cartridge having the configuration in which a toner sealing member that is a sheet member is wound and unsealed via an unsealing member and at least one hole is formed in the toner sealing member.

First, if fluidity of the toner is decreased during distribution, a sufficient amount of toner may not pass through the at least one hole, depending on the size of the at least one hole or the number of holes. This may increase the load for moving (i.e., winding and unsealing) the toner sealing member. Thus, it is necessary to set the size of the at least one hole to be large enough so that the toner having lowered fluidity can pass through the at least one hole, or to increase the number of holes. Meanwhile, it is problematic in that, if the size of the at least one hole formed in the toner sealing member is excessively large or if an excessively larger number of holes are formed in the toner sealing member, the strength of the toner sealing member is decreased.

SUMMARY OF THE INVENTION

An embodiment of the present invention is directed to a developer container, a developing device, a process cartridge, and an image forming apparatus that are capable of reducing increase in the load for moving a sheet member even if fluidity of developer decreases.

According to an aspect of the present invention, a developer container including an opening and accommodating developer includes a sheet member that includes a plurality of holes through which the developer is caused to pass and that seals the opening, and an unsealing member that includes a plurality of protruded portions and that unseals and reveals the opening by moving the sheet member, wherein, as the unsealing member rotates, the protruded portions respectively pass through the holes, and ends of the protruded portions protrude from a side of the sheet member, the side being opposite to a side on which the unsealing member is located.

According to another aspect of the present invention, a developer container accommodating developer includes a sheet member that includes a plurality of holes through which the developer is caused to pass, and a conveyance member that includes a plurality of protruded portions and that is configured to convey the developer, wherein, the sheet member is fixed to the conveyance member and moves while changing its shape as the conveyance member rotates, and wherein, as the conveyance member rotates, the protruded portions respectively pass through the holes, and ends of the protruded portions protrude from a side of the sheet member, the side being opposite to a side on which the conveyance member is located.

Further features of the present invention will become apparent from the following description of exemplary embodiments with reference to the attached drawings.

DESCRIPTION OF THE EMBODIMENTS

An embodiment of the present invention will be described in detail with reference to the drawings. Hereinafter, the rotation axis direction of a photosensitive drum serving as an image bearing member will be referred to as a longitudinal direction. In addition, a side on which the photosensitive drum receives drive force from an apparatus main body of an image forming apparatus in the longitudinal direction will be referred to as a drive side, and a side opposite thereto will be referred to as a non-drive side.

<Overall Configuration of Image Forming Apparatus>

An overall configuration of an image forming apparatus will be described with reference to FIG. 2.

Figure 2:
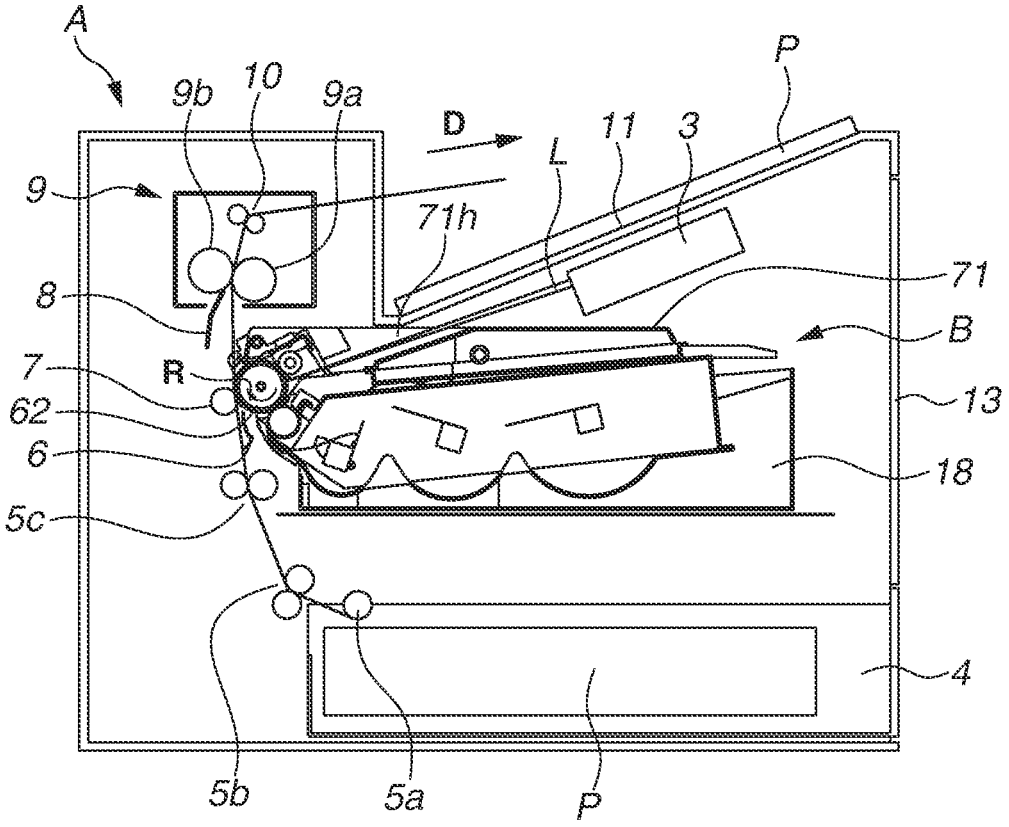
FIG. 2 is a cross-sectional view of an apparatus main body of an image forming apparatus and a process cartridge according to the exemplary embodiment.

FIG. 2 is a cross-sectional view of an apparatus main body (hereinafter, referred to as an apparatus main body A) of an electrophotographic image forming apparatus (hereinafter, referred to as an image forming apparatus) and a process cartridge (hereinafter, referred to as a cartridge B) according to an exemplary embodiment of the present invention. The apparatus main body A corresponds to part of the image forming apparatus except for the cartridge B.

The image forming apparatus illustrated in FIG. 2 is a laser beam printer using electrophotographic technology. The cartridge B is attachable to and detachable from the apparatus main body A. When the cartridge B is set inside the apparatus main body A, an exposure device 3 (a laser scanner unit) for forming an electrostatic image on an electrophotographic photosensitive drum (hereinafter, referred to as a drum) 62 in the cartridge B is arranged. In addition, a sheet tray 4 holding recording material (hereinafter, referred to as a sheet material P) on which images are formed is arranged under the cartridge B.

In addition, in the apparatus main body A, a pick-up roller 5*a*, a feed roller pair 5*b*, a conveyance roller pair 5*c*, a transfer guide 6, a transfer roller 7, a conveyance guide 8, a fixing device 9, a discharge roller pair 10, a discharge tray 11, etc. are sequentially arranged in a conveyance direction D of the sheet material P. The fixing device 9 includes a heat roller 9*a* and a pressure roller 9*b*.

<Image Forming Process>

Figure 3:
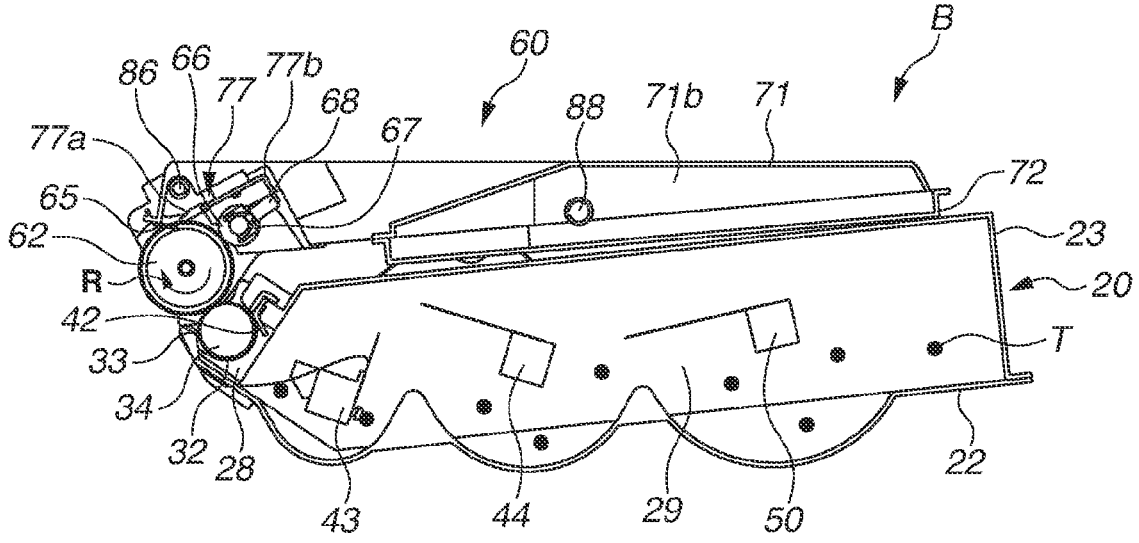
FIG. 3 is a cross-sectional view of the process cartridge according to the exemplary embodiment.

Next, an outline of an image forming process will be described with reference to FIGS. 2 and 3. FIG. 2 is a cross-sectional view of the apparatus main body A and the cartridge B. FIG. 3 is a cross-sectional view of the cartridge B.

As illustrated in FIG. 2, based on a print start signal, the drum 62 is rotated in the direction indicated by an arrow R at a predetermined circumferential velocity (process speed).

As illustrated in FIG. 3, when a bias voltage is applied to a charging roller 66, the charging roller 66 comes into contact with the outer peripheral surface of the drum 62 and evenly charges this outer peripheral surface.

As illustrated in FIG. 2, the exposure device 3 outputs laser light L based on image information. The laser light L passes through a laser opening 71*h* arranged in a cleaning frame 71 of the cartridge B and scans the outer peripheral surface of the drum 62. In this way, an electrostatic latent image (an electrostatic image) based on the image information is formed on the outer peripheral surface of the drum 62 charged by the charging roller 66.

In addition, as illustrated in FIG. 3, in a developing unit 20 serving as a developing device, toner T in a toner chamber 29 serving as a developer container is agitated and conveyed to a developing chamber 28 by rotation of a first conveyance member 43, a second conveyance member 44, and a third conveyance member 50.

By magnetic force of a magnet roller 34 (a stationary magnet), the toner T is borne on a surface of a developing roller 32 serving as a developer carrying member. In the present exemplary embodiment, a developing sleeve containing the magnet roller 34 corresponds to a developer carrying member. A developing blade 42 frictionally charges the toner T while regulating the layer thickness of the toner T on the outer peripheral surface of the developing roller 32. Next, the toner T is developed on the drum 62 on the basis of the electrostatic latent image and is visualized as a developer image (or a toner image).

In addition, as illustrated in FIG. 2, in accordance with the output timing of the laser light L, a sheet material P held in the bottom part of the apparatus main body A is conveyed from the sheet tray 4 by the pick-up roller 5*a*, the feed roller pair 5*b*, and the conveyance roller pair 5*c*. The sheet material P is conveyed to a position (a transfer position) between the drum 62 and the transfer roller 7 after conveyed to the transfer guide 6. A toner image is sequentially transferred from the drum 62 to the sheet material P at the transfer position.

The sheet material P on which the toner image has been transferred is separated from the drum 62 and conveyed to the fixing device 9 along the conveyance guide 8. The sheet material P passes through a nip portion between the heat roller 9*a* and the pressure roller 9*b* included in the fixing device 9. Heated and pressed at the nip portion, the toner image is fixed on the sheet material P. The sheet material P on which the toner image has been fixed is conveyed to the discharge roller pair 10 and is discharged onto the discharge tray 11 in the conveyance direction D.

As illustrated in FIG. 3, after the toner image is transferred, the residual toner on the outer peripheral surface of the drum 62 is removed by the cleaning blade 77 and is used again for the next image forming process. The toner removed from the drum 62 is stored in a waste toner chamber 71*b* of a cleaning unit 60.

In the present exemplary embodiment, the charging roller 66, the developing roller 32, the transfer roller 7, and the cleaning blade 77 are process units that act on the drum 62 in the above image forming process.

<Attachment and Detachment of Cartridge>

Figure 5A:
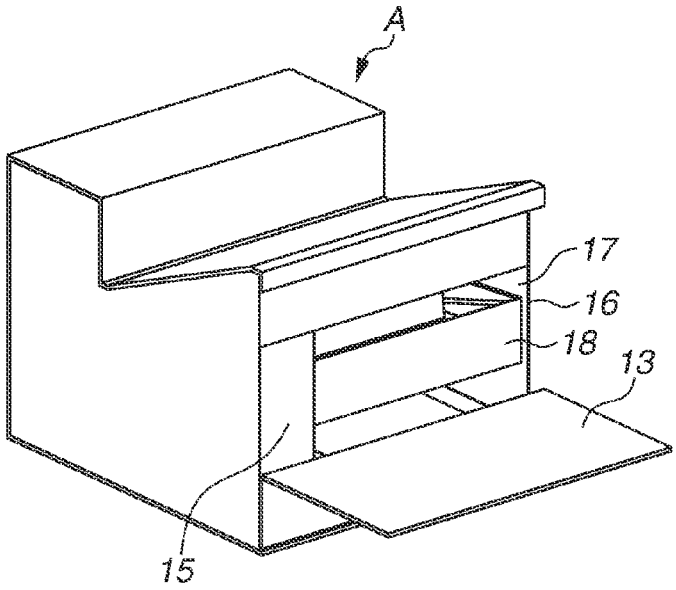
FIGS. 5A to 5C are perspective views illustrating attachment of the process cartridge to the image forming apparatus according to the exemplary embodiment and detachment of the process cartridge from the image forming apparatus according to the exemplary embodiment.
Figure 5B:
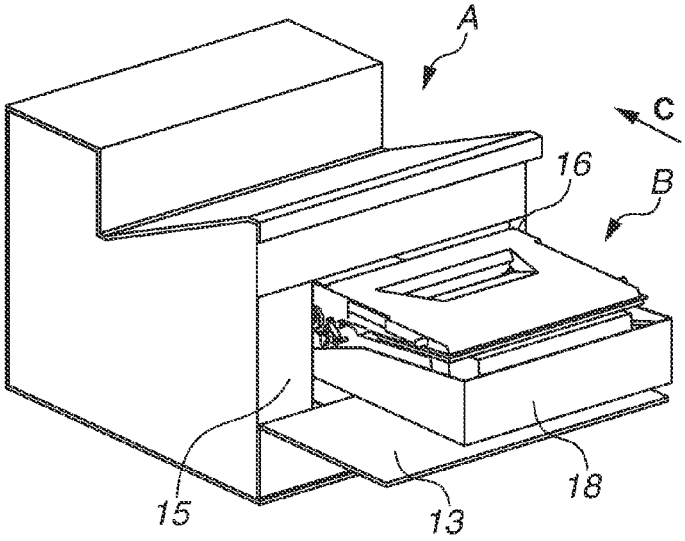
Figure 5C:
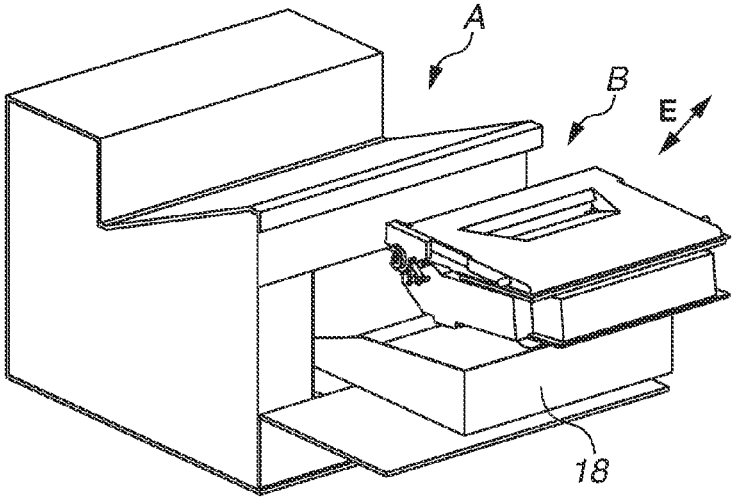
Figure 6:
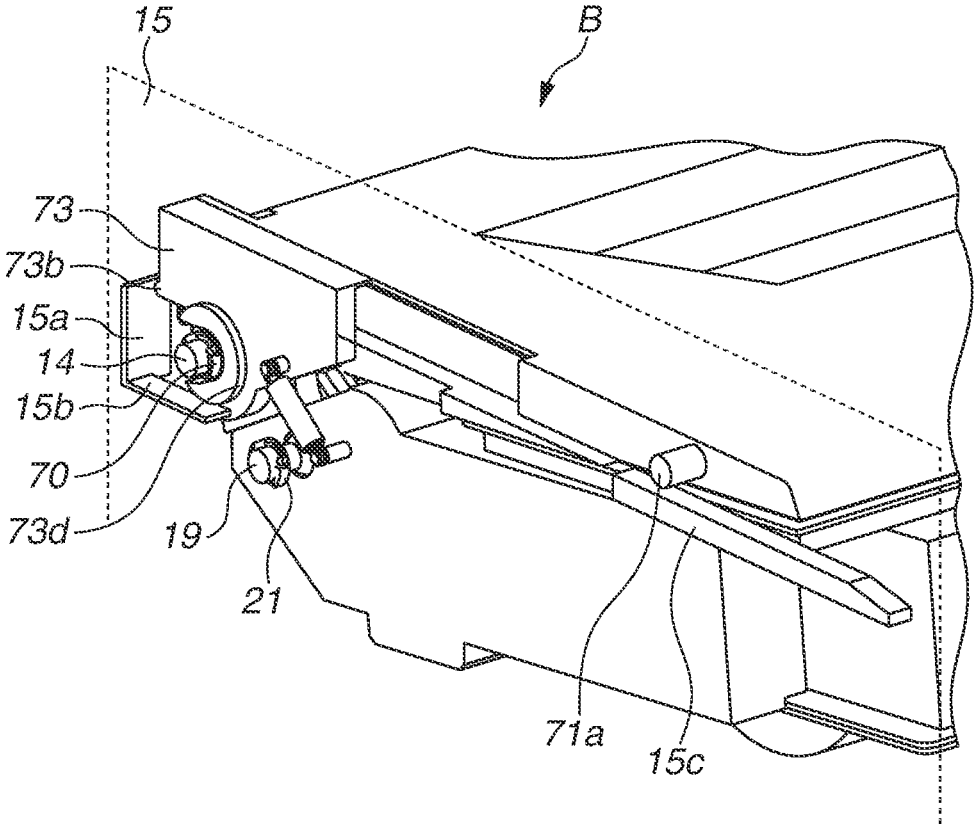
FIG. 6 is a perspective view of a drive side positioning portion of the process cartridge and the apparatus main body according to the exemplary embodiment, in a state in which the process cartridge is attached to the apparatus main body.

Next, attachment and detachment of the cartridge B to and from the apparatus main body A will be described with reference to FIGS. 5A to 5C. FIG. 5A is a perspective view of the apparatus main body A in a state in which a door 13 is opened so that the cartridge B can be attached to or detached from the apparatus main body A. FIG. 5B is a perspective view of the apparatus main body A and the cartridge B in a state in which the door 13 is opened and a tray 18 is drawn so that the cartridge B can be attached to or detached from the apparatus main body A. FIG. 5C is a perspective view of the apparatus main body A and the cartridge B in a state in which the cartridge B is being attached to or detached from the apparatus main body A with the door 13 opened and the tray 18 drawn. FIG. 6 is a perspective view of a drive side positioning portion of the cartridge B and of the apparatus main body A, the cartridge B having been set inside the apparatus main body A.

As illustrated in FIG. 5A, the door 13 is turnably attached to the apparatus main body A. When the door 13 is opened, a cartridge insertion opening 17 is seen. In the cartridge insertion opening 17, the tray 18 for attaching the cartridge B to the apparatus main body A is arranged. As illustrated in FIG. 5B, with the tray 18 drawn to a predetermined position, the cartridge B can be attached to or detached from the apparatus main body A. The cartridge B placed on the tray 18 is inserted into the apparatus main body A along a guide rail (not illustrated) in the direction indicated by an arrow C, thereby attaching the cartridge B to the apparatus main body A. As illustrated in FIG. 5C, attachment and detachment of the cartridge B with respect to the tray 18 is performed in the direction indicated by an arrow E.

In addition, as illustrated in FIG. 6, the apparatus main body A is provided with a first drive shaft 14 and a second drive shaft 19. The first drive shaft 14 transmits drive force to a first coupling 70 of the cartridge B. The second drive shaft 19 transmits drive force to a second coupling 21. The first drive shaft 14 and the second drive shaft 19 are driven by a motor (not illustrated) of the apparatus main body A. In this way, the drum 62 connected to the first coupling 70 is rotated by receiving the drive force from the apparatus main body A. In addition, the developing roller 32 is rotated by the transmission of the drive force from the second coupling 21. A power feed unit (not illustrated) of the apparatus main body A applies a predetermined bias to the charging roller 66 and the developing roller 32.

<Configuration for Supporting Cartridge>

Figure 7:
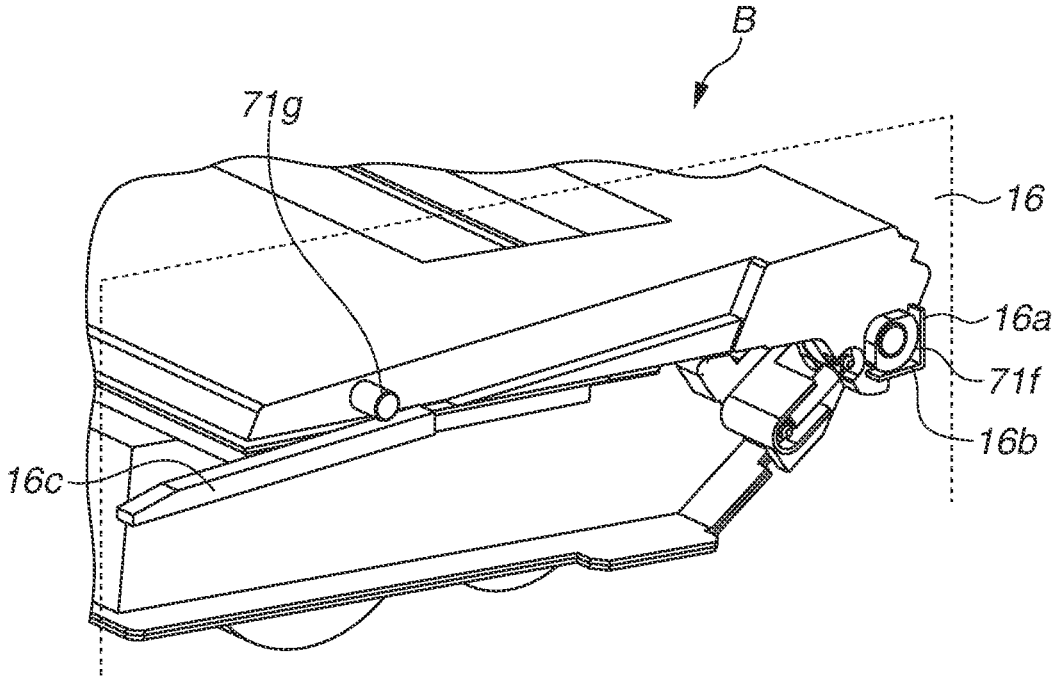
FIG. 7 is a perspective view of a non-drive side positioning portion of the process cartridge and the apparatus main body according to the exemplary embodiment, in a state in which the process cartridge is attached to the apparatus main body.

Next, how the apparatus main body A supports the cartridge B will be described with reference to FIGS. 5A to 5C, 6, and 7. FIG. 5A is a perspective view of the apparatus main body A in a state in which the door 13 is opened so that the cartridge B can be attached to or detached from the apparatus main body A. FIG. 6 is a perspective view of a drive side positioning portion of the cartridge B and the apparatus main body A, in a state in which the process cartridge B is attached to the apparatus main body A. FIG. 7 is a perspective view of a non-drive side positioning portion of the cartridge B and the apparatus main body A, in a state in which the process cartridge B is attached to the apparatus main body A.

As illustrated in FIG. 5A, the apparatus main body A is provided with a drive side plate 15 and a non-drive side plate 16 for supporting the cartridge B. As illustrated in FIG. 6, the drive side plate 15 indicated by a dotted line is provided with a first drive side supporting portion 15*a*, a second drive side supporting portion 15*b*, and a rotary supporting portion 15*c* of the cartridge B. In addition, as illustrated in FIG. 7, the non-drive side plate 16 indicated by a dotted line is provided with a first non-drive side supporting portion 16*a*, a second non-drive side supporting portion 16*b*, and a rotary supporting portion 16*c*.

In addition, as illustrated in FIG. 6, a supported portion 73*b* and a supported portion 73*d* of a drum bearing 73 and a drive side boss 71*a* are arranged as drive side supported portions of the cartridge B. The supported portion 73*b* is supported by the first drive side supporting portion 15*a*, and the supported portion 73*d* is supported by the second drive side supporting portion 15*b*. In addition, the drive side boss 71*a* is supported by the rotary supporting portion 15*c*.

In addition, as illustrated in FIG. 7, a non-drive side projection 71*f* and a non-drive side boss 71*g* are arranged as the non-drive side supported portions of the cartridge B. The non-drive side projection 71*f* is supported by the first non-drive side supporting portion 16*a* and the second non-drive side supporting portion 16*b*, and the non-drive side boss 71*g* is supported by the rotary supporting portion 16*c*. With the above configuration, the cartridge B is positioned inside the apparatus main body A.

<Overall Configuration of Cartridge>

Figure 4A:
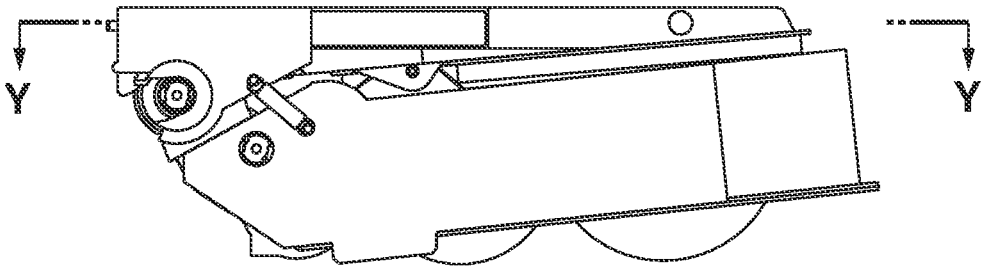
FIG. 4A is a side view of the process cartridge according to the exemplary embodiment.
Figure 4B:
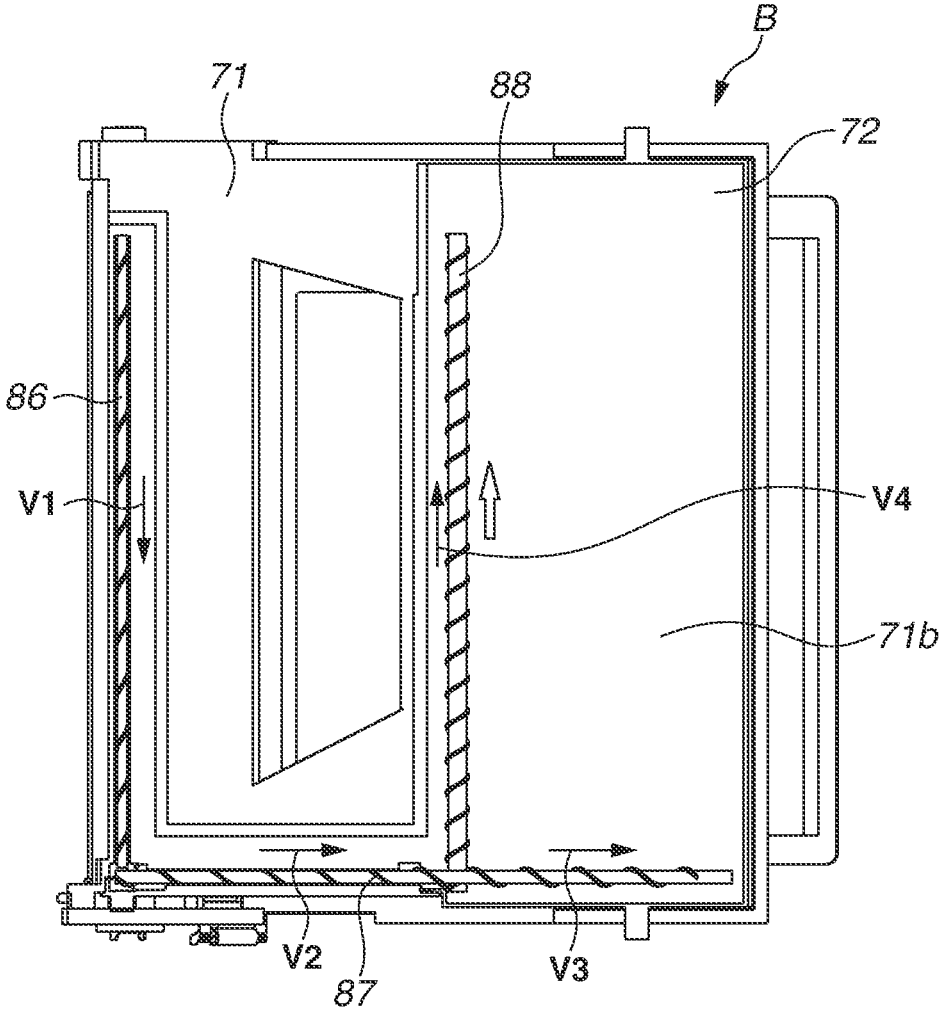
FIG. 4B is a cross-sectional view of an internal configuration of a cleaning frame of the process cartridge according to the exemplary embodiment.
Figure 8:
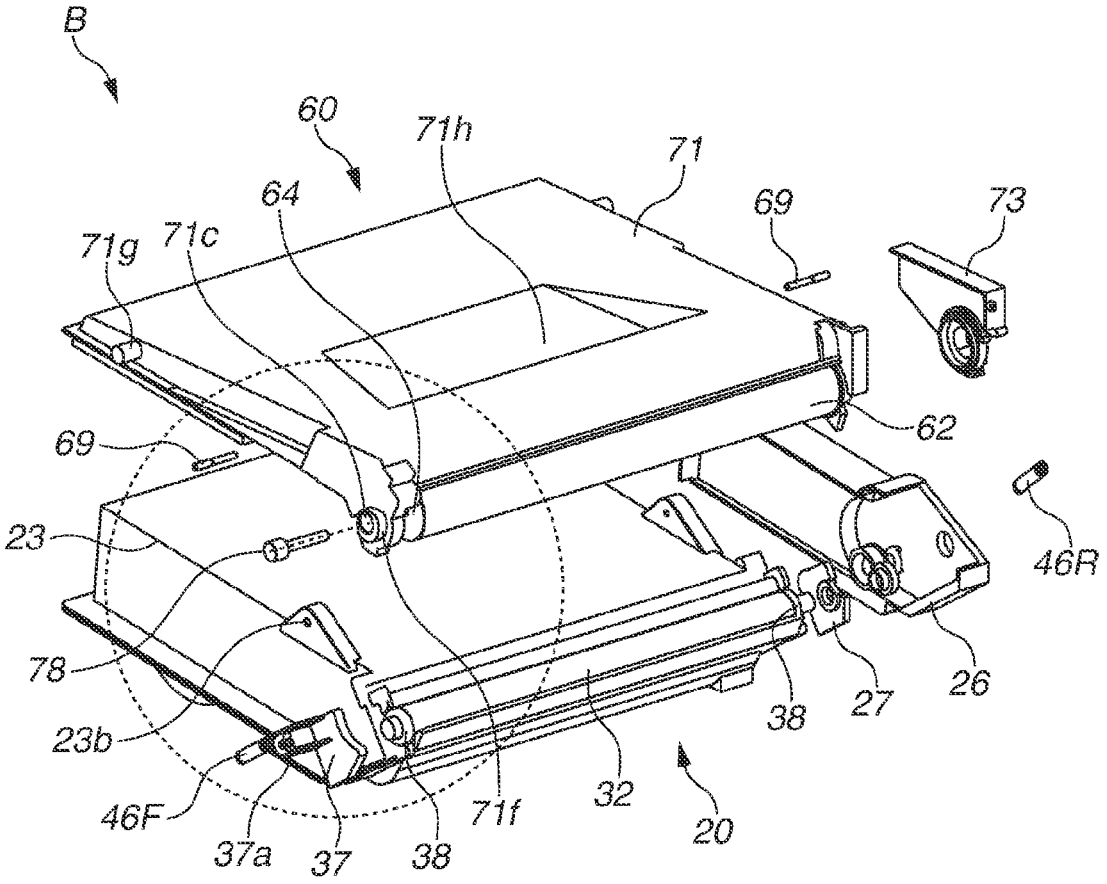
FIG. 8 is an overall perspective view of the process cartridge according to the exemplary embodiment, in a state in which the process cartridge is disassembled, seen from a non-drive side.
Figure 9:
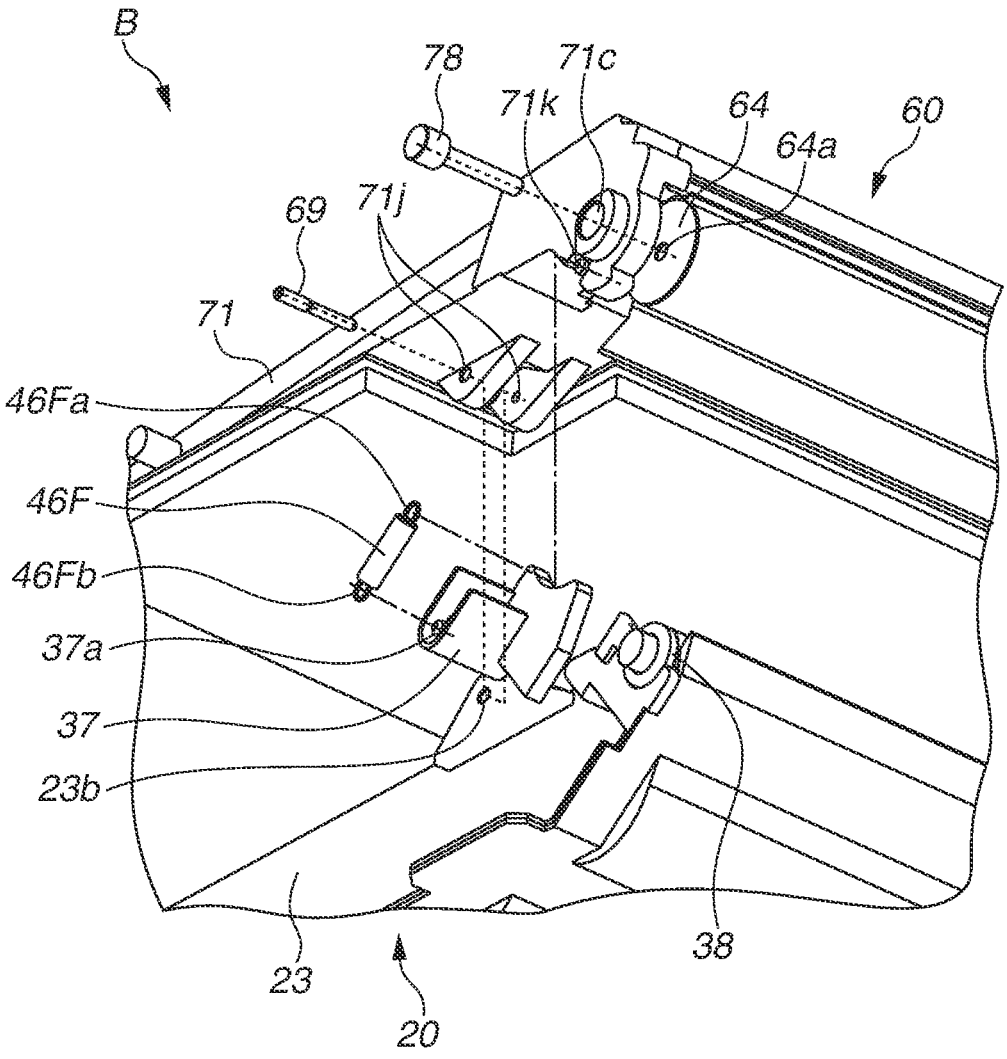
FIG. 9 is a fragmentary perspective view of the process cartridge according to the exemplary embodiment, in a state in which the process cartridge is disassembled, seen from the non-drive side.
Figure 10:
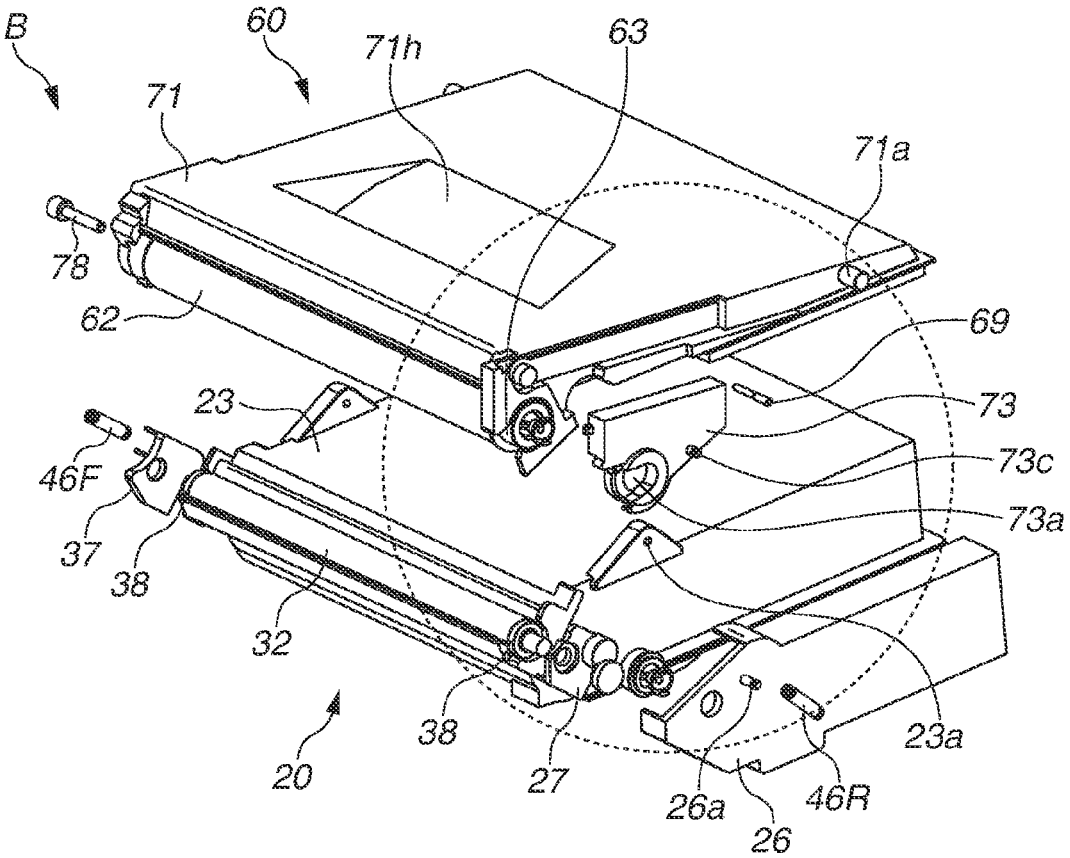
FIG. 10 is an overall perspective view of the process cartridge according to the exemplary embodiment, in a state in which the process cartridge is disassembled, seen from a drive side.
Figure 11:
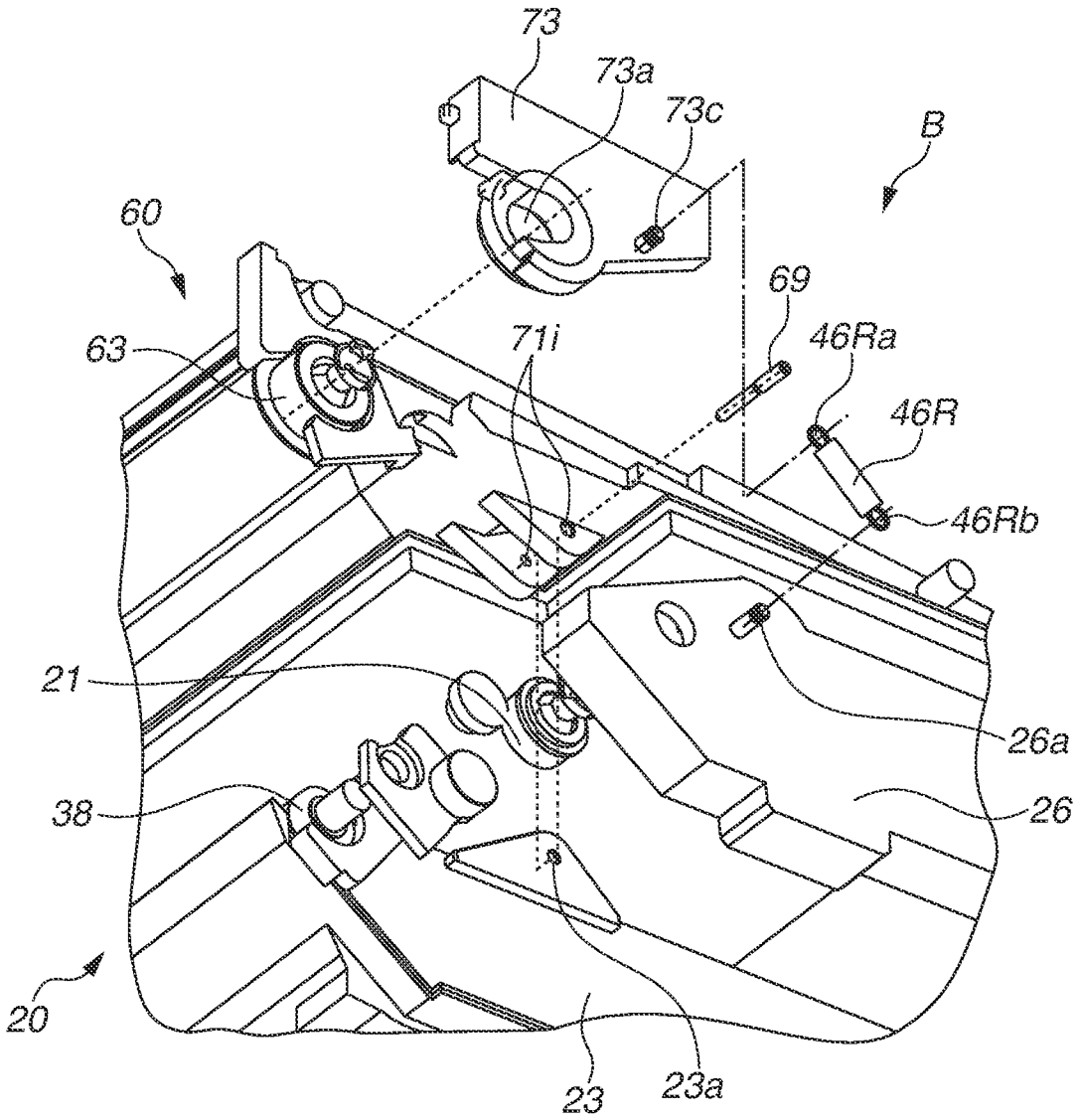
FIG. 11 is a fragmentary perspective view of the process cartridge according to the exemplary embodiment, in a state in which the process cartridge is disassembled, seen from the drive side.

Next, an overall configuration of the cartridge B will be described with reference to FIGS. 3, 4A and 4B, and 8 to 11. FIG. 3 is a cross-sectional view of the cartridge B. FIG. 4A is a side view of the cartridge B. FIG. 4B is a cross-sectional view of the cleaning frame 71. FIG. 8 is an overall perspective view of the cartridge B seen from the non-drive side. FIG. 9 is a fragmentary perspective view of the cartridge B seen from the non-drive side. FIG. 10 is an overall perspective view of the cartridge B seen from the drive side. FIG. 11 is a fragmentary perspective view of the cartridge B seen from the drive side.

FIG. 4A is a side view of the cartridge B seen from the drive side, and FIG. 4B is a cross-sectional view of an internal configuration of the cleaning frame 71, taken along a dashed line indicated by Y in FIG. 4A. FIG. 9 is an enlarged view of a portion indicated by a dotted line in FIG. 8 (the portion is illustrated at a different angle). FIG. 11 is an enlarged view of a portion indicated by a dotted line in FIG. 10 (the portion is illustrated at a different angle). In the description of the present exemplary embodiment, the description of screws used for coupling various elements will be omitted.

As illustrated in FIG. 3, the cartridge B includes the cleaning unit 60 and the developing unit 20.

In addition, the cleaning unit 60 includes the drum 62, the charging roller 66, and the cleaning member 77, which are supported by the cleaning frame 71. A cover member 72 is fixed to the cleaning frame 71 by welding or the like. The charging roller 66 and the cleaning member 77 are arranged in such a manner that these elements are in contact with the outer peripheral surface of the drum 62.

The cleaning member 77 is formed by a rubber blade 77*a*, which is a blade-shaped elastic member, and a supporting member 77*b* supporting the rubber blade 77*a*. The rubber blade 77*a* is in contact with the drum 62 in the direction opposite to the direction of the rotation of the drum 62. Namely, the rubber blade 77*a* is in contact with the drum 62 in such a manner that an end portion of the rubber blade 77*a* faces the upstream side in the direction of the rotation of the drum 62.

As illustrated in FIG. 4B, the waste toner removed from the surface of the drum 62 by the cleaning member 77 is conveyed by a first screw 86, a second screw 87, and a third screw 88, which serve as waste toner conveyance members, in the directions respectively indicated by arrows V1 to V4. The waste toner is stored in the waste toner chamber 71*b* formed by the cleaning frame 71 and the cover member 72. The first screw 86 is rotated by causing a gear (not illustrated) and the like to transmit the drive force that the cartridge B receives from the apparatus main body A. The second screw 87 is rotated by receiving the drive force from the first screw 86. The third screw 88 is rotated by receiving the drive force from the first screw 87. The first screw 86 is arranged near the drum 62. The second screw 87 is arranged at an end portion of the cleaning frame 71 in a longitudinal direction thereof. The third screw 88 is arranged in the waste toner chamber 71*b*. The rotary shafts of the first and third screws 86 and 88 are in parallel to the rotary shaft of the drum 62. The rotary shaft of the second screw 87 is perpendicular to the rotary shaft of the drum 62.

In addition, as illustrated in FIG. 3, a scooping sheet 65, which is for preventing leakage of the waste toner from the cleaning frame 71, is arranged at an end portion of the cleaning frame 71 in such a manner that the scooping sheet 65 is in contact with the drum 62.

The drum 62 receives drive force from a main body drive motor (not illustrated) serving as a drive source and is rotated in the direction indicated by the arrow R in FIG. 3 based on the image forming operation.

The charging roller 66 is rotatably attached to the cleaning unit 60 via a charging roller bearing 67 at either end in the longitudinal direction of the cleaning frame 71 (in parallel to the direction of the rotary shaft of the drum 62). Since a biasing member 68 presses the charging roller bearing 67 in the direction of the drum 62, the charging roller 66 is pressed against the drum 62. The charging roller 66 is driven by the rotation of the drum 62.

The developing unit 20 includes the developing roller 32 and the developing blade 42. The developing roller 32 and the developing blade 42 are supported by a developer case 23. A bottom member 22 is fixed to the developer case 23 by welding or the like. As a result, the toner chamber 29 is formed. The developing roller 32 is a hollow developing roller, and the magnet roller 34 is arranged therein. The developing blade 42 regulates the toner layer on the developing roller 32. As illustrated in FIG. 8, an interval-keeping member 38 is attached to either end of the developing roller 32. Since the interval-keeping members 38 come into contact with the drum 62, the developing roller 32 is held with a predetermined interval from the drum 62. In addition, as illustrated in FIG. 3, a leakage prevention sheet 33 is arranged at an end portion of the bottom member 22 in such a manner that the leakage prevention sheet 33 is in contact with the developing roller 32. The leakage prevention sheet 33 prevents leakage of toner from the developing unit 20. The first conveyance member 43, the second conveyance member 44, and the third conveyance member 50 are arranged as conveyance units in the toner chamber 29. Each of the first conveyance member 43, the second conveyance member 44, and the third conveyance member 50 rotates clockwise, agitates the toner accommodated in the toner chamber 29, and conveys the toner to the developing chamber 28.

As illustrated in FIG. 10, the drum bearing 73 and a drum shaft 78 are arranged in the cleaning unit 60. As illustrated in FIG. 11, since a drive side drum flange 63 on the drive side is arranged in a hole portion 73*a* of the drum bearing 73, the drum 62 is rotatably supported. In addition, as illustrated in FIG. 9, on the non-drive side, the drum shaft 78 pressed into a hole portion 71*c* of the cleaning frame 71 is rotatably supported by a hole portion 64*a* of a non-drive side drum flange 64.

In addition, as illustrated in FIGS. 8 and 10, the developing roller 32 of the developing unit 20 is rotatably supported by bearing members 27 and 37 arranged at both ends of the developing roller 32.

In addition, as illustrated in FIGS. 9 and 11, the cleaning unit 60 and the developing unit 20 are turnably coupled via coupling pins 69. More specifically, as illustrated in FIG. 11, a first developing supporting hole 23*a* is formed in the developer case 23 on the drive side of the developing unit 20. As illustrated in FIG. 9, a second developing supporting hole 23*b* is formed on the non-drive side.

In addition, as illustrated in FIG. 11, first hanging holes 71*i* are formed in the cleaning frame 71 on the drive side of the cleaning unit 60. As illustrated in FIG. 9, second hanging holes 71*j* are formed on the non-drive side. As illustrated in FIG. 11, on the drive side, a coupling pin 69 pressed into and fixed inside the first hanging holes 71*i* is fitted into the first developing supporting hole 23*a*. On the non-drive side, a coupling pin 69 pressed into and fixed inside the second hanging holes 71*j* is fitted into the second developing supporting hole 23*b*. With this configuration, the developing unit 20 is turnably coupled to the cleaning unit 60.

In addition, as illustrated in FIG. 11, a first hole portion 46Ra of a drive side biasing member 46R is hung on a boss 73*c* of the drum bearing 73, and a second hole portion 46Rb of the drive side biasing member 46R is hung on a boss 26*a* of drive side developing side member 26. In addition, as illustrated in FIG. 9, a first hole portion 46Fa of a non-drive side biasing member 46F is hung on a boss 71*k* of the cleaning frame 71, and a second hole portion 46Fb of the non-drive side biasing member 46F is hung on a boss 37*a* of the bearing member 37. In the present exemplary embodiment, the drive side biasing member 46R and the non-drive side biasing member 46F are formed by using tension springs, and the biasing force of the springs biases the developing unit 20 to the cleaning unit 60. In this way, the developing roller 32 is pressed to come into contact with the drum 62 without fail.

<Configuration of Toner Sealing Member>

Figure 1A:
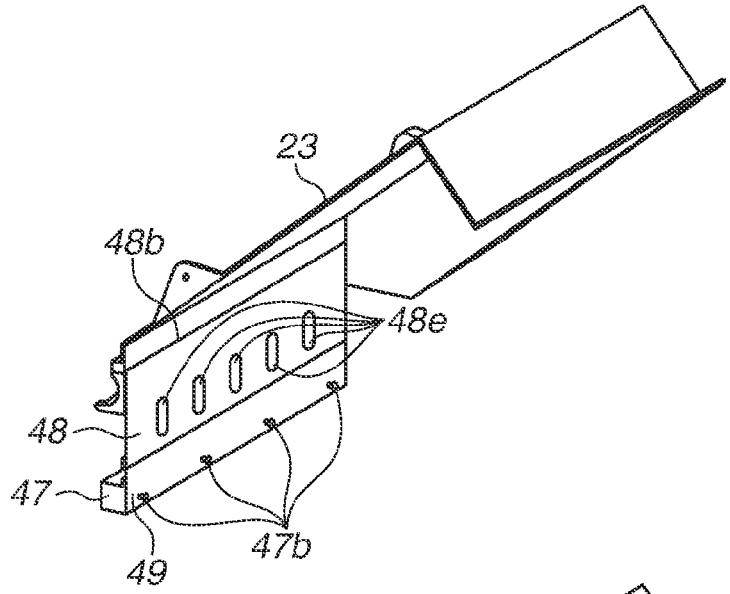
FIGS. 1A to 1C are fragmentary perspective views each illustrating a part of a conveyance member (or an unsealing member) or a part of a container according to an exemplary embodiment.
Figure 1B:
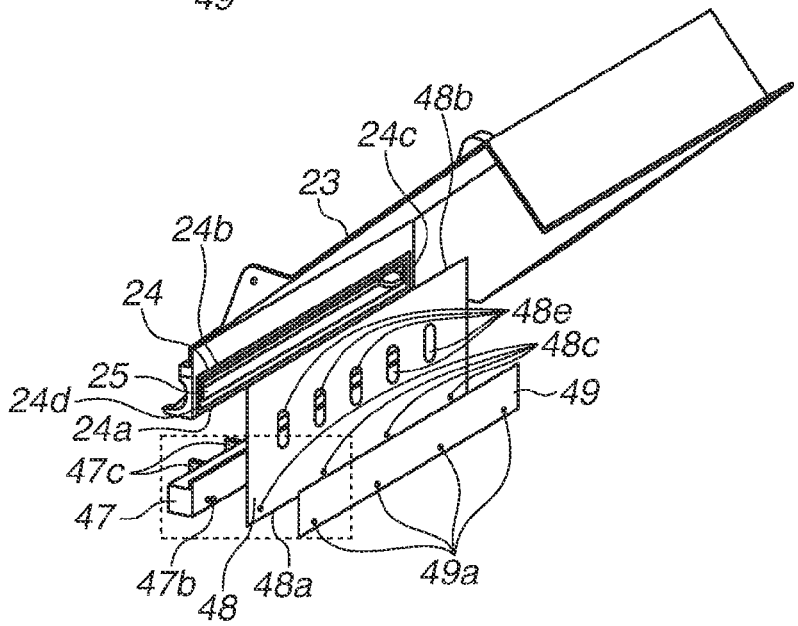
Figure 1C:
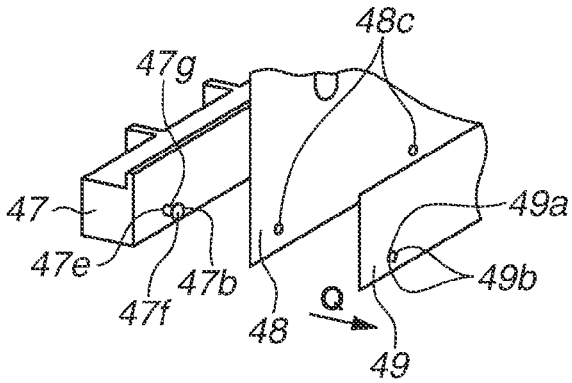
Figure 12:
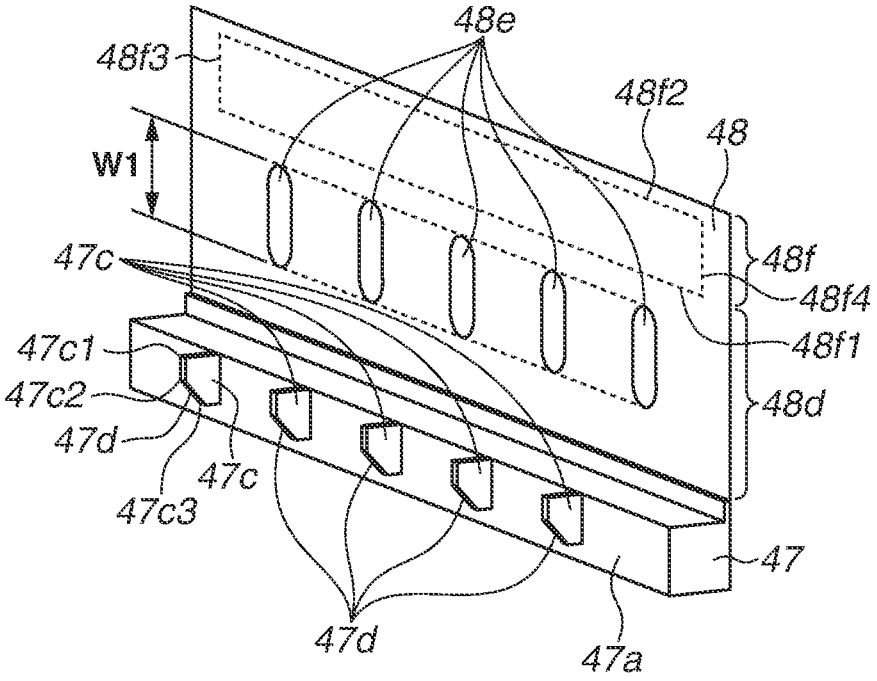
FIG. 12 is a perspective view of the conveyance member (or the unsealing member) and a sheet member according to the exemplary embodiment.

Next, a toner sealing member as a sheet member will be described with reference to FIGS. 1A to 1C and 12. FIG. 1A is a perspective view illustrating a state where the developer case 23 and a toner sealing member 48 are connected to each other, and the toner sealing member 48, a conveyance sheet 49, and a rotary member 47 are further connected together. FIG. 1B is a perspective view illustrating a state where the developer case 23, the rotary member 47, the toner sealing member 48, and the conveyance sheet 49 have not yet been connected together. FIG. 1C is an enlarged view of a portion in FIG. 1B. FIG. 12 is a perspective view of the rotary member 47 and the toner sealing member 48 that are connected to each other.

As illustrated in FIG. 1A, the toner sealing member 48 is fixed to the rotary member 47 and the developer case 23. The rotary member 47 has attachment bosses 47*b*, as illustrated in FIG. 1B. The conveyance sheet 49 has sheet attachment holes 49*a*. The rotary member 47 and the conveyance sheet 49 are coupled to each other when the attachment bosses 47*b* are fitted into the sheet attachment holes 49*a*. As illustrated in FIG. 1C, since a base 47*e* of each of the attachment bosses 47*b* is fitted into a corresponding one of the sheet attachment holes 49*a*, these elements have a fit tolerance relationship. Thus, an individual end 47*f* is thicker than a corresponding base 47*e*. When the conveyance sheet 49 is attached to the rotary member 47, the sheet attachment holes 49*a* are fitted with the bases 47*e* by passing over the ends 47*f*. To allow the sheet attachment holes 49*a* to pass over the ends 47*f*, a sheet slit 49*b* may be arranged as a slit on the outside of each of the attachment holes 49*a* or elastic material may be used for the conveyance sheet 49. By forming the conveyance sheet 49 in such a shape, even when the conveyance sheet 49 is pulled in the direction opposite to the attachment boss 47*b* (in the direction indicated by an arrow Q), since the sheet attachment holes 49*a* is caught by steps 47*g* formed by the bases 47*e* and the ends 47*f*, the conveyance sheet 49 is not detached from the rotary member 47. The toner sealing member 48 has seal attachment holes 48*c* and is coupled to the rotary member 47, as is the case with the conveyance sheet 49. In this way, the toner sealing member 48, the conveyance sheet 49, and the rotary member 47 are connected together.

The toner sealing member 48, the conveyance sheet 49, and the rotary member 47 may be connected together in a different way. For example, these elements may be swaged, welded, or connected with a two-sided adhesive tape. In addition, while the conveyance sheet 49 and the toner sealing member 48 are attached to the rotary member 47 at the same attachment positions in the present exemplary embodiment, the conveyance sheet 49 and the toner sealing member 48 may be attached to the rotary member 47 at different attachment positions. In addition, while the conveyance sheet 49 is arranged in the present exemplary embodiment, a part of the rotary member 47 may be formed in the shape of a protrusion to form a conveyance portion without using a conveyance sheet. Namely, while in the present exemplary embodiment the conveyance sheet 49 and the rotary member 47 are used to form a conveyance member, the present invention is not limited to this example. In addition, as will be described below, a rotary member serving as a conveyance member according to the present exemplary embodiment also serves as an unsealing member. In the present exemplary embodiment, two sheet members are used, the toner sealing member 48 serving as a first sheet member and the conveyance sheet 49 serving as a second sheet member. However, the present invention is not limited to this example.

A second end portion 48*b* of the toner sealing member 48 is detachably fixed to the rim of an opening 25 in the developer case 23 by heat welding or the like. This fixed portion will be referred to as a sealing portion 24 of the developer case 23. The sealing portion 24 may be formed by a different method other than by heat welding. For example, adhesion, laser welding, or the like may be used.

As illustrated in FIG. 1B, the sealing portion 24 on the developing case 23 is formed by first and second sealing portions 24*a* and 24*b*, respectively, that extend in the longitudinal direction of the opening 25 and third and fourth sealing portions 24*c* and 24*d*, respectively, that extend in the transverse direction of the opening 25. Since the first to fourth sealing portions 24*a* to 24*d* are continuously formed, the toner can be sealed. Seen from the opening 25, the first sealing portion 24*a* is positioned in the direction of a first end portion 48*a* of the toner sealing member 48, and the second sealing portion 24*b* is positioned in the direction of the second end portion 48*b*, which is positioned in the opposite direction of the first end portion 48*a*. The third sealing portion 24*c* is positioned on the non-drive side, and the fourth sealing portion 24*d* is positioned on the drive side. In the exemplary embodiment, while the sealing portion 24 of the frame of the developing case 23 has been described, the sealing member 48 also has a corresponding sealing portion 48*f*, as illustrated in FIG. 12. As illustrated in FIG. 12, the sheet member 48 has first to fourth second sealing portions 48*f*1 to 48*f*4 corresponding to the sealing portion of the frame.

As illustrated in FIG. 12, a shaft portion 47*a* of the rotary member 47 has a plurality of protrusions 47*c* in the longitudinal direction as a plurality of protruded portions. In addition, each of the protrusions 47*c* has an inclined surface 47*d* near its ends 47*c*1 to 47*c*3. These protrusions 47*c* are protrusions different from the above attachment bosses 47*b*. The protrusions 47*c* protrude from the shaft portion 47*a* in the rotation radius direction of the rotary member 47 and have a rotation radius larger than that of the attachment bosses 47*b*. In addition, a connecting portion 48*d* between the seal attachment holes 48*c* and the sealing portion 48*f* of the toner sealing member 48 has a plurality of holes 48*e* in the longitudinal direction. Each of the holes 48*e* is formed in the shape of an ellipse, and the length of its long side is W1.

Figure 13A:
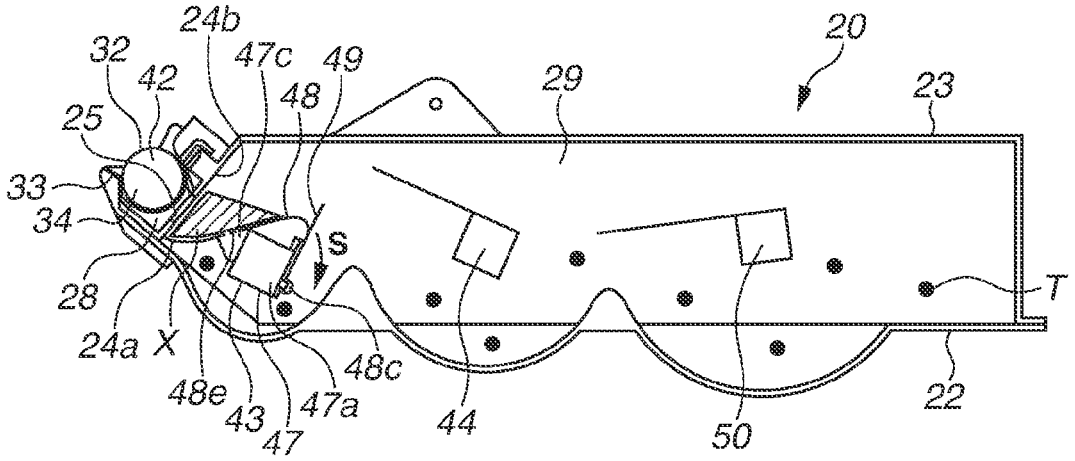
FIGS. 13A to 13C are cross-sectional views of a developing unit, illustrating how a toner sealing member is unsealed to reveal an opening, according to the exemplary embodiment.
Figure 13B:
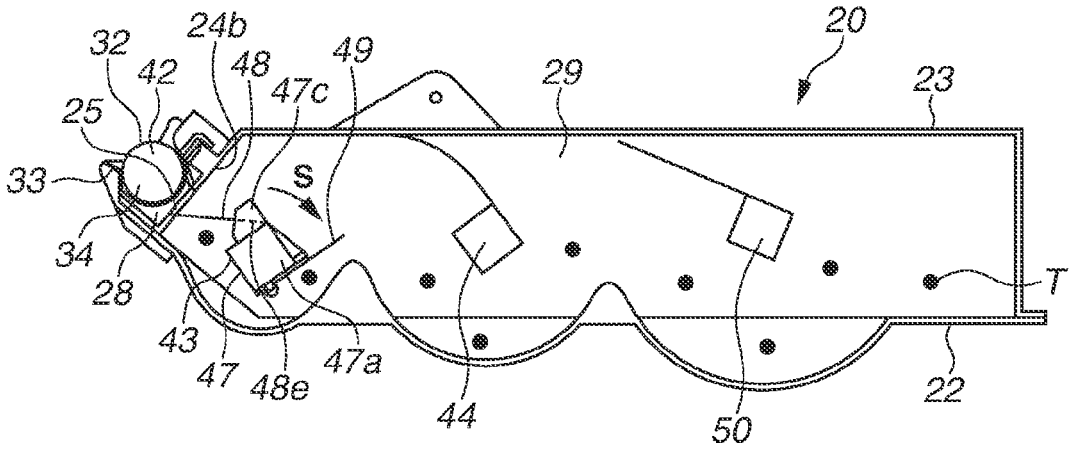

When the toner sealing member 48 is wound around the shaft portion 47*a* along the trajectory of the rotation of the rotary member 47 in an unsealing operation by the toner sealing member 48, which will be described below with reference to FIG. 13B, the holes 48*e* overlap the protrusions 47*c* of the rotary member 47. In other words, the protrusions 47*c* are inserted into the holes 48*e*. In addition, when the rotary member 47 is rotated and when the toner sealing member 48 is deformed along the trajectory of the rotation and is wound around the shaft portion 47*a* and unsealed, the ends 47*c*1 to 47*c*3 of each of the portion protrusions 47*c* passes through a corresponding one of the holes 48*e*. Thus, since the toner sealing member 48 does not interfere with the protrusions 47*c*, the protrusions 47*c* protrude from a surface of the toner sealing member 48. In this state, the ends of the protrusions are positioned (protrude) on a side of the toner sealing member, the side being opposite to the side on which the unsealing member is located. In other words, the ends of the protrusions are divided into a side from which the ends are inserted into the holes of the toner sealing member and a side opposite to the side, and the ends of the protrusions are protruded from the side opposite to the side from which the ends of the protrusions are inserted.

The toner sealing member 48 needs to have a sufficient length so that the toner sealing member 48 can cover the opening 25 and can be attached to the rotary member 47. Next, a case in which the toner sealing member 48 is wound around the shaft portion 47*a* along the trajectory of the rotation of the rotary member 47 after the toner sealing member 48 is detached from the developer case 23 in the unsealing operation by the toner sealing member 48 will be described. In this case, if an end of the toner sealing member 48 interferes with a transverse-side end of the conveyance sheet 49, the toner conveyance operation by the conveyance sheet 49 could be blocked. Thus, it is preferable that the length of the toner sealing member 48 be set in such a manner that the end of the toner sealing member 48 does not interfere with the transverse-side end of the conveyance sheet 49. In addition, it is preferable that the length of the conveyance sheet 49 in the transverse direction be set in such a manner that the conveyance sheet does not cover the holes in the toner sealing member. Depending on the position of the conveyance sheet 49, the protrusions 47*c* could not smoothly be inserted into the holes 48*e*. Consequently, the toner could not be agitated efficiently.

<Unsealing Operation by Toner Sealing Member>

Figure 13C:
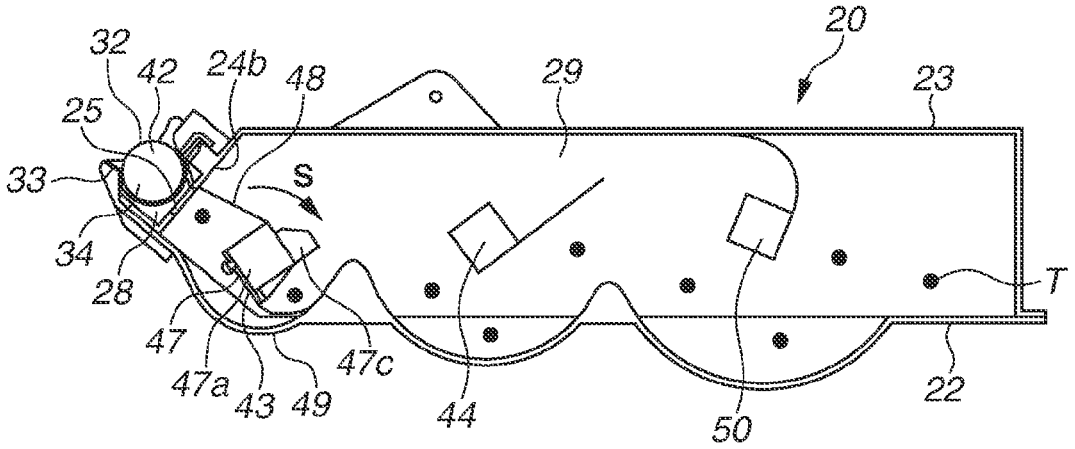
Figure 15:
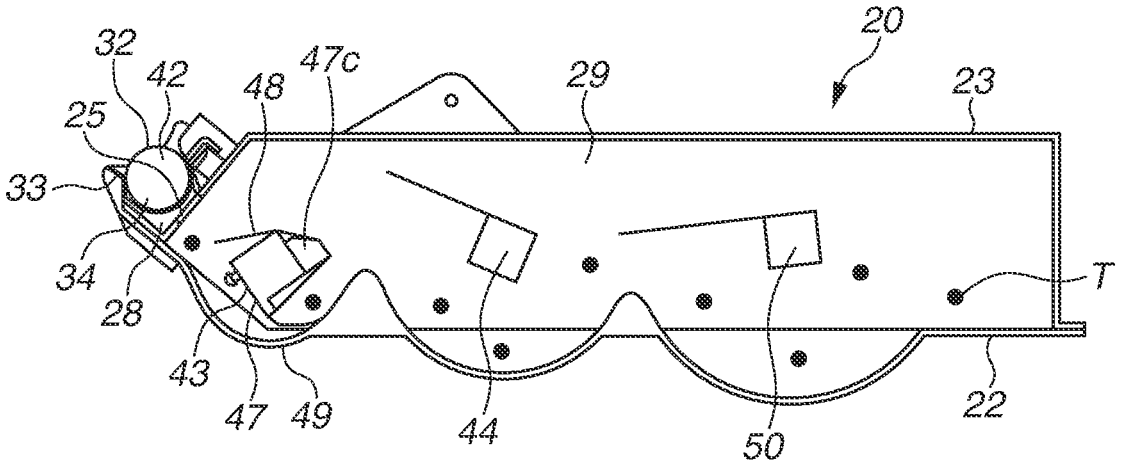
FIG. 15 is a cross-sectional view of a developing unit according to a comparative example.

Next, an operation of unsealing the toner sealing member will be described with reference to FIGS. 13A to 13C and FIG. 15. FIGS. 13A to 13C are cross-sectional views illustrating how the toner sealing member 48 is unsealed to reveal the opening 25. FIG. 15 is a cross-sectional view of the developing unit 20 including the toner sealing member 48 without the holes 48*e*.

As illustrated in FIG. 13A, the toner sealing member 48 is loosely attached to the developing case 23 by providing slackness between the first sealing portion 24*a* and the seal attachment holes 48*c* which are fitting portions. In this way, even when force is applied to the rotary member 47 and is consequently rotated during assembly or distribution of the cartridge B, since this slackness prevents occurrence of tension in the toner sealing member 48, the sealing is maintained.

When the cartridge B is set inside the apparatus main body A and when the apparatus main body A receives drive force, the rotary member 47 is rotated in the direction indicated by an arrow S. When the rotary member 47 is rotated, the toner sealing member 48 is wound around the rotary member 47 and unsealed, and tension is applied in the toner sealing member 48 as illustrated in FIG. 13B. When the rotary member 47 is further rotated, the first sealing portion 24*a*, the third sealing portion 24*c*, the fourth sealing portion 24*d*, and the second sealing portion 24*b* of the toner sealing member 48 are sequentially detached from the developing case 23 in this order as illustrated in FIG. 13C. As a result, the opening 25 is unsealed, and the toner is supplied by the conveyance member 43 from the toner chamber 29 to the developing chamber 28. In the present exemplary embodiment, as the unsealing member is rotated, the toner sealing member is moved, and the opening is unsealed. However, the toner sealing member may be moved by moving the unsealing member horizontally.

The toner sealing member 48 needs to push away the toner in an region X in FIG. 13A from when the unsealing (detaching) of the first sealing portion 24*a* is started as illustrated in FIG. 13A to when the detaching is completed as illustrated in FIG. 13C as the rotary member 47 is rotated. In this operation, the ends of the protrusions 47*c* protruding from the surface of the toner sealing member 48 via the holes 48*e* thrust into the toner in the region X and loosen the toner. As a result, since the fluidity of the toner in the region X is increased, the rotary member 47 needs less force to push away the toner, compared with a case in which the rotary member 47 does not have the protrusions 47*c*. In other words, less load is needed to rotate the rotary member 47, which serves not only as an unsealing member but also as a conveyance member. In addition, the loosened toner passes through the holes 48*e* in the toner sealing member 48 more efficiently. Thus, since the toner sealing member 48 needs to push away a smaller amount of toner, the toner sealing member 48 needs less force to push away the toner, compared with a case in which the toner sealing member 48 does not have the holes. In other words, less load is needed to rotate the rotary member 47.

A case in which the toner sealing member 48 does not have the holes 48*e* will be described with reference to FIG. 15. In this case, the toner sealing member 48 is wound around the rotary member 47 along the trajectory of the rotation of the rotary member 47. After wound, as illustrated in FIG. 15, the protrusions 47*c* interfere with the toner sealing member 48, and the toner sealing member is wound around the outside of the protrusions 47*c*. Thus, since the protrusions 47*c* cannot protrude from the toner sealing member 48, the protrusions 47*c* cannot loosen the toner in the region X that needs to be pushed away. Namely, more load is needed to rotate the rotary member 47. In addition, the toner sealing member 48 wound around the protrusions 47*c* always receives resistance from the toner, as the rotary member 47 is rotated. Namely, more load is needed to rotate the rotary member 47. Thus, to reduce the load needed to rotate the rotary member 47, the toner sealing member 48 needs to have the holes 48*e*.

As described above, by using the protrusions 47*c* and the holes 48*e*, less load is needed to rotate the rotary member 47 when the sealing portion 24 is unsealed. This advantageous effect is particularly significant when the fluidity of the toner has been decreased by vibration during distribution, for example.

This reduction of the load achieves downsizing of a motor transmitting power to the rotary member 47 and reduction of the power consumption of the motor. Thus, downsizing of the apparatus main body A and reduction of the power consumption of the apparatus main body A can be achieved.

In the present exemplary embodiment, the rotary member serving as a conveyance member also serves as an unsealing member. Namely, since the rotary member has both conveyance and unsealing functions, fewer parts are needed. However, the present invention is not limited to this example. An unsealing member other than a conveyance member may be used.

<Arrangement of Protrusions in Longitudinal Direction>

Next, the arrangement of the protrusions 47*c* in the longitudinal direction will be described with reference to FIG. 12. FIG. 12 is a perspective view of the rotary member 47 and the toner sealing member 48 coupled to each other. The plurality of protrusions 47*c* is arranged along the rotation axis direction of the rotary member 47. The protrusions 47*c* are arranged to widely loosen the toner that the toner sealing member 48 needs to push away. By widely loosening the toner, the fluidity of the toner (in the region X) that the toner sealing member 48 needs to push away is increased. As a result, since the toner sealing member 48 can push away the toner more easily, the load needed to rotate the rotary member 47 can effectively be reduced. If the number of protrusions 47*c* is decreased, a smaller region of toner is loosened, and the toner that the toner sealing member 48 needs to push away has lower fluidity, compared with the configuration in which the protrusions 47*c* are arranged as illustrated in FIG. 12. However, depending on the configuration, a smaller number of protrusions could be sufficient. In addition, if a protrusion 47*c* is arranged only at either end of the rotary member 47 in the longitudinal direction, the toner loosened by the protrusions 47*c* is not the toner on the toner sealing member 48. Thus, the fluidity of the toner that the toner sealing member 48 needs to push away cannot be increased. In this case, the load needed to rotate the rotary member 47 cannot be decreased. Namely, to decrease the load needed to rotate the rotary member 47, the protrusion 47*c* and the toner sealing member 48 need to overlap each other in the longitudinal direction, and the protrusions 47*c* need to be inserted into the holes 48*e*.

<Shape of Ends of Protrusions>

Figure 14A:
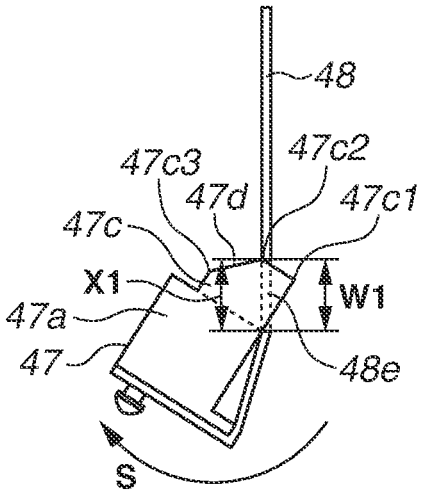
FIGS. 14A to 14C are cross-sectional views of the conveyance member (or the unsealing member) and the sheet member according to the exemplary embodiment.
Figure 14B:
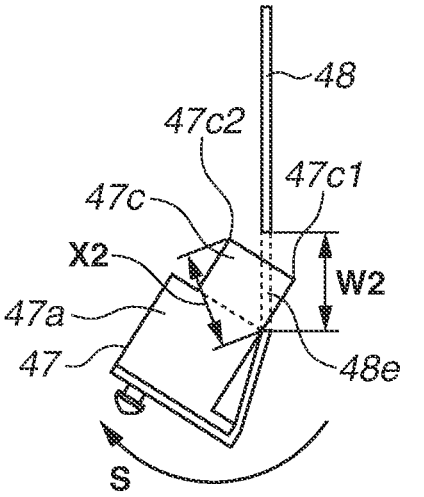
Figure 14C:
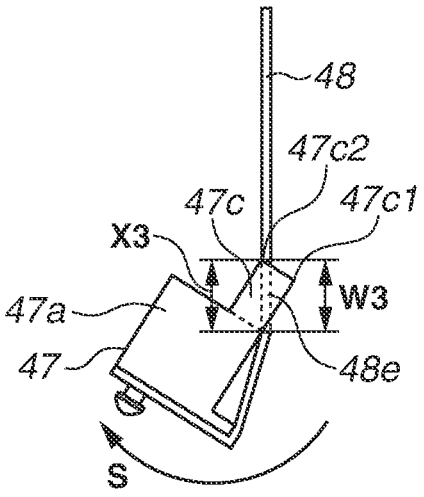

Next, the shape of an end of a protrusion 47*c* will be described with reference to FIGS. 14A to 14C. FIGS. 14A to 14C are cross-sectional views each illustrating that the rotary member 47 winds and unseals the toner sealing member 48. FIGS. 14B and 14C are variations of a protrusion 47*c*. An individual dashed line in FIGS. 14A to 14C indicates a hole 48*e*. The ends 47*c*1 to 47*c*3 of the protrusion 47*c* will be referred to as first to third ends 47*c*1 to 47*c*3 sequentially from the upstream side in the rotation direction.

An individual hole 48*e* is formed in the shape of an ellipse, and the length of its long side is W1. As the rotary member 47 is rotated, the toner sealing member 48 is wound around the shaft portion 47*a* and unsealed, and the first ends 47*c*1 of the protrusions 47*c* pass through the respective holes 48*e*. Subsequently, the second and third ends 47*c*2 and 47*c*3 of the protrusions 47*c* are inserted into the respective holes 48*e*. The toner sealing member 48 is bent at the bases of the protrusions 47*c* and is wound around the rotary member 47 and unsealed. Assuming that the maximum height of an individual protrusion 47*c* from the bent portion of the toner sealing member 48 is X1, the outer edge of the corresponding hole 48*e* passes by outside the second end 47*c*2 of the protrusion 47*c* (an end that corresponds to the maximum height X1 in FIG. 14A). Namely, it is preferable that the length W1 of an individual hole 48*e* be set in such a manner that the outer edge of the hole 48*e* does not interfere with the maximum height X1 of the corresponding protrusion 47*c*.

In the present exemplary embodiment, between the second end 47*c*2 and the third end 47*c*3 of an individual protrusion 47*c*, an inclined surface 47*d* is formed. As illustrated in FIG. 14A, in a cross-sectional view of the rotary member 47 and the toner sealing member 48 taken along a line perpendicular to the rotation axis of the rotary member 47, the width (thickness) of the border (a dotted line) between the protrusion 47*c* and the shaft portion 47*a* of the rotary member 47 is longer than the width of an end (between the first end 47*c*1 and the second end 47*c*2) of the protrusion 47*c*. In addition, the protrusion 47*c* is tapered toward the end. This is to prevent the outer edge of the hole 48*e* from interfering with the second end 47*c*2 of the protrusion 47*c* located downstream in the direction of the rotation when the toner sealing member 48 is wound around the shaft portion 47*a* and unsealed. Namely, with the inclined surface 47*d*, a smaller height is needed as the above maximum height X1, and the protrusion 47*c* can pass through the hole 48*e* without interfering with the outer edge of the hole 48*e*. In contrast, as illustrated in FIG. 14B, if the end (the length between the first end 47*c*1 and the second end 47*c*2) and the base of the protrusion 47*c* have the same thickness, namely, if the inclined surface 47*d* is not formed, the maximum height X1 in FIG. 14A is increased to X2 as illustrated in FIG. 14B (X2>X1). Thus, since the hole 48*e* needs to have a length W2 larger than the length W1 to prevent the hole from interfering with the end of the protrusion 47*c* (W2>W1), the strength of the toner sealing member 48 could be affected. Next, a case in which the hole 48*e* has a length W3, which is the same length as that in FIG. 14A (W3=W1), and the end and the base of the protrusion 47*c* have the same thickness (width) without the inclined surface 47*d* as illustrated in FIG. 14C will be described. In this case, since the maximum height X3 is the same as that in FIG. 14A (X3=X1), the outer edge of the hole 48*e* does not interfere with the end of the protrusion 47*c*. However, since the base of the protrusion 47*c* is thinner than that of the protrusion 47*c* in FIG. 14A, the strength of the border between the protrusion 47*c* and the shaft portion 47*a* is decreased. Thus, to ensure the strength of both of the toner sealing member 48 and the individual protrusion 47*c*, it is preferable that the protrusion 47*c* have the inclined surface 47*d* and that the end of the protrusion 47*c* be thinner than its base. Shaped in this way, since the base of the individual protrusion 47*c* can be made thick, the strength of the protrusion can be ensured. In addition, since the length W1 of the hole 48*e* can be made short, the strength of the toner sealing member 48 can be ensured. Of course, the shape as illustrated in FIG. 14B or 14C may be used.

In addition, the protrusion 47*c* is a plate-like member and has a small width in the direction of the rotation axis of the rotary member 47 as illustrated in FIG. 12. By forming the individual protrusion 47*c* to have a small width, the clearance between the protrusion 47*c* and the corresponding hole 48*e* is ensured, and the toner passes through the hole 48*e* via a larger area. By allowing a larger amount of toner to pass through the hole 48*e*, the amount of toner that the toner sealing member 48 needs to push away is decreased, and the load needed to rotate the rotary member 47 is decreased. Even if the individual protrusion 47*c* has a wider width, by widening the width of the individual hole 48*e*, the clearance can be ensured in a like manner. If individual protrusion 47*c* has a wider width, the protrusion 47*c* resists the rotation of the rotary member 47 in toner having low fluidity. Thus, the width of the individual protrusion 47*c* needs to be designed in consideration of the load needed to detach the toner sealing member 48 and the resistance load. For example, if the individual protrusion 47*c* is designed to thrust into and loosen the toner before the load needed to detach the toner sealing member 48 is applied, a higher degree of freedom can be obtained in designing the width of the individual protrusion 47*c*. If the application of the load needed to detach the toner sealing member 48 and the thrusting of the individual protrusion 47*c* into the individual hole 48*e* are performed at the same timing, larger load is applied. Thus, it is preferable that the width of the individual protrusion 47*c* be smaller.

As described above, it is preferable that the end of the individual protrusion 47*c* be tapered in the direction of the rotation of the rotary member 47 and the width of the protrusion 47*c* be small in the direction of the rotation axis. By forming the protrusions 47*c* in this shape, it is possible to decrease the load needed to rotate the rotary member 47 while ensuring the strength of the toner sealing member 48.

<Other Configuration Examples of Protrusions and Holes>

Next, other configuration examples of the protrusions 47*c* and the holes 48*e* will be described with reference to FIGS. 16A to 16C and FIGS. 17A to 17C.

Figure 16A:
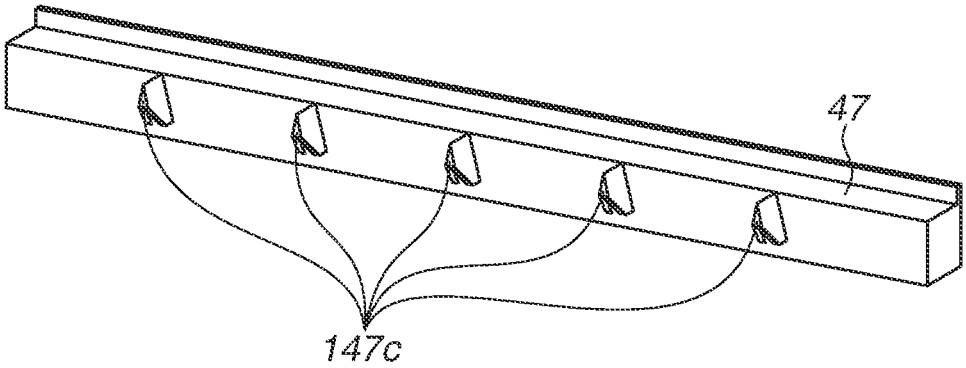
FIGS. 16A to 16C are perspective views of conveyance members (or unsealing members) according to variations of the exemplary embodiment.
Figure 16B:
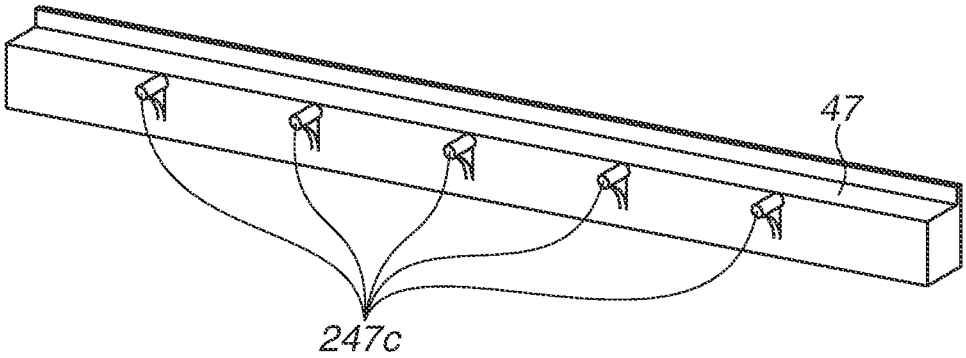
Figure 16C:
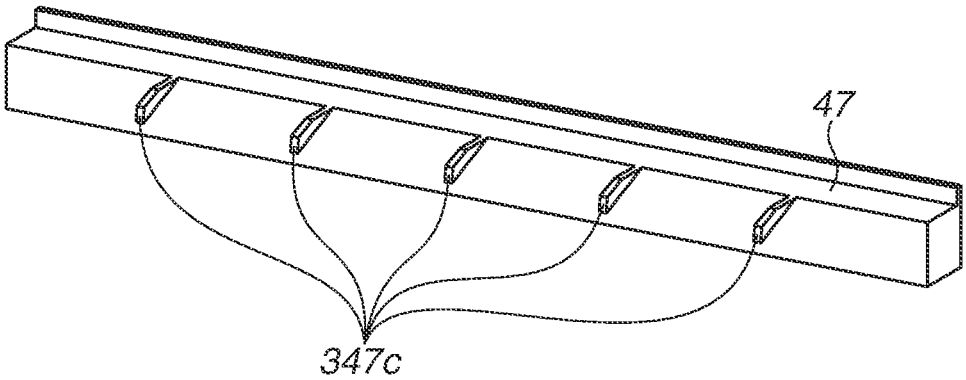

FIGS. 16A to 16C are perspective views illustrating variations of the protrusion 47*c* illustrated in FIG. 12. The rotary member 47 may have protrusions 147*c* each formed in the shape of a wedge as illustrated in FIG. 16A. Alternatively, the rotary member 47 may have protrusions 247*c* each formed in the shape of a cylinder as illustrated in FIG. 16B. Alternatively, the rotary member 47 may have protrusions 347*c* each tilted in the rotation direction as illustrated in FIG. 16C. The shapes of the protrusions 47*c*, 147*c*, 247*c*, and 347*c* in FIGS. 12 and 16 are only examples according to an exemplary embodiment of the present invention. Other shapes may also be applicable. In addition, the number of and the arrangement of protrusions are not limited to what is illustrated in FIGS. 12 and 16.

Figure 17A:
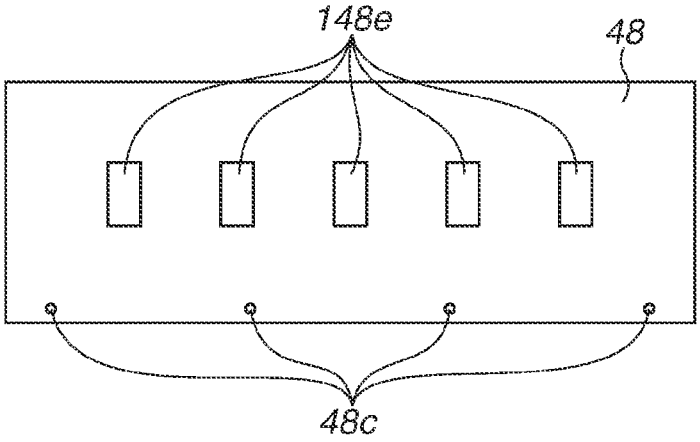
FIGS. 17A to 17C are plan views of holes in toner sealing members according to variations of the exemplary embodiment.
Figure 17B:
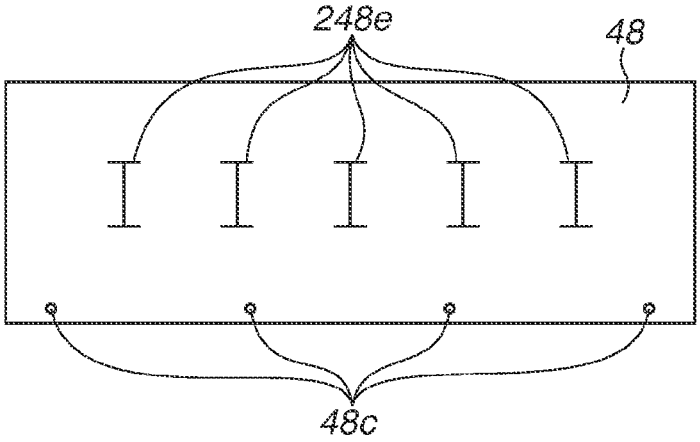
Figure 17C:
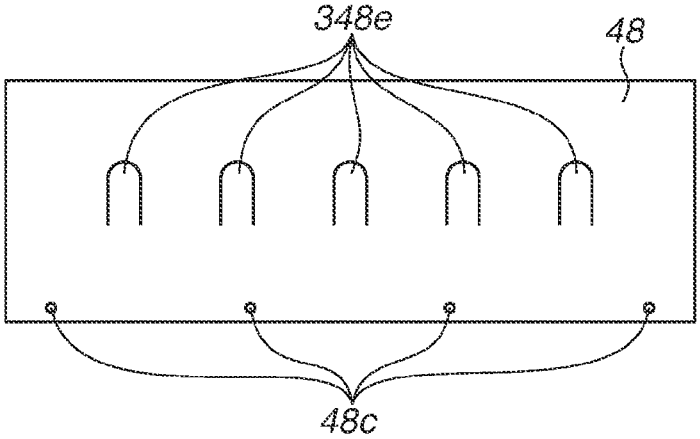

FIGS. 17A to 17C are plan views illustrating variations of the holes 48*e* illustrated in FIG. 12. The toner sealing member 48 may have rectangular holes 148*e* as illustrated in FIG. 17A. Alternatively, the toner sealing member 48 may have I-shaped holes 248*e* as illustrated in FIG. 17B. Alternatively, the toner sealing member 48 may have inverted U-shaped holes 348*e* as illustrated in FIG. 17C. As is the case with the protrusions 47*c*, the shape, number, and arrangement of the holes 48*e* are not limited to what is illustrated in FIGS. 12 and 17.

As described above, as long as an individual protrusion thrusts into a corresponding hole, the positional relationship is not particularly limited.

In the present exemplary embodiment, the toner sealing member has been described as a sheet member, a different sheet member attached to the rotary member may be used. For example, an embodiment of the present invention is also applicable to a developer container or a developing device that does not include a toner sealing member and that includes a sheet member conveyance toner to a conveyance member. In this case, after the toner on the sheet member is loosened, the sheet member is moved. Thus, since the toner is conveyed efficiently, less load is needed to drive the conveyance member in an initial operation. In a configuration including a conveyance member and a sheet member, at least one hole may be formed in the sheet member, and a protrusion of the conveyance member may be allowed to pass through the hole. The sheet member may be moved after the toner on the sheet member is loosened. In addition, while reduction of the load is not achieved until the protrusion loosens the toner, the sheet member and the protrusion may be moved at the same timing.

In addition, as long as the rotary member is a moving member included in the conveyance unit, the rotary member may perform an operation other than rotation.

In the above exemplary embodiment, the process cartridge is attachable to and detachable from the apparatus main body of the image forming apparatus. However, the present invention is not limited thereto. The developer container or the developing device may independently be attachable to and detachable from the apparatus main body. In addition, the developer container may independently be removed from the developing device.

In the above exemplary embodiment, the frame has the opening, and the opening is sealed by the sealing member. However, the present invention is not limited to such example. For example, the cartridge may include, other than a frame, a flexible container accommodating toner, and the flexible container may be contained in the frame. In this case, the flexible container has a plurality of openings and accommodates toner therein, with the openings being sealed by a sealing member. By moving the sealing member, the openings in the flexible container are unsealed. As a result, the toner can be supplied to a developer carrying member such as a developing roller, for example. In this case, the flexible container accommodating toner has lower strength than that of the above frame or case having the openings. Thus, when the openings are unsealed, the flexible container is deformed while being pulled by the sealing member. Since the openings are also pulled by the sealing member, the positions of the openings are also changed (deformation of the openings). Japanese Patent Application Laid-Open 2013-257540 discusses a flexible container.

As described above, according to an embodiment of the present invention, it is possible to reduce increase of the load caused when the sheet member is moved even when developer has lower fluidity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-199795, filed Oct. 7, 2015, which is hereby incorporated by reference herein in its entirety.

What is claimed is:

1. A developer container including an opening and accommodating developer, the developer container comprising:

a sheet member that includes a plurality of holes through which the developer is caused to pass and that seals the opening; and an unsealing member that includes a plurality of protruded portions and that unseals and reveals the opening by moving the sheet member, wherein, as the unsealing member rotates, the protruded portions respectively pass through the holes, and ends of the protruded portions protrude from a side of the sheet member, the side being opposite to a side on which the unsealing member is located.

2. The developer container according to claim 1, wherein the unsealing member is arranged inside the developer container.

3. The developer container according to claim 1, wherein the unsealing member includes an attachment portion configured to attach the sheet member to the unsealing member, and the protruded portions are protrusions different from the attachment portion.

4. The developer container according to claim 3, wherein a rotation radius of each of the protruded portions is larger than a rotation radius of the attachment portion.

5. The developer container according to claim 1, wherein the ends of the protruded portions respectively pass through the holes before peeling of the sheet member from the developer container starts, and the peeling of the sheet member starts thereafter.

6. The developer container according to claim 1, wherein each of the ends of the protruded portions has an inclined surface located on an upstream side in a direction of rotation of the unsealing member.

7. The developer container according to claim 1, wherein, in a case where the sheet member is a first sheet member, the developer container further comprises a second sheet member configured to convey the developer, and wherein a length of the second sheet member in a transverse direction thereof is shorter than a length of the first sheet member in a transverse direction thereof.

8. The developer container according to claim 7, wherein the second sheet member is arranged in such a manner that the second sheet member does not cover the holes in the first sheet member.

9. The developer container according to claim 7, wherein the first sheet member is arranged between the second sheet member and the unsealing member.

10. The developer container according to claim 1, wherein the sheet member is fixed to the developer container at sealing portions, wherein the sealing portions includes a first sealing portion and a second sealing portion that extend in a longitudinal direction of the opening, and a third sealing portion and a fourth sealing portion that extend in a transverse direction of the opening, wherein the first sealing portion is peeled off before the third sealing portion and the fourth sealing portion are peeled off, and wherein the second sealing portion is peeled off after the first sealing portion is peeled off.

11. A developer container accommodating developer, the developer container comprising:

a sheet member that includes a plurality of holes through which the developer is caused to pass; and a conveyance member that includes a plurality of protruded portions and that is configured to convey the developer, wherein, the sheet member is fixed to the conveyance member and moves while changing its shape as the conveyance member rotates, and wherein, as the conveyance member rotates, the protruded portions respectively pass through the holes, and ends of the protruded portions protrude from a side of the sheet member, the side being opposite to a side on which the conveyance member is located.

12. The developer container according to claim 11, wherein the conveyance member is arranged inside the developer container.

13. The developer container according to claim 11, wherein the conveyance member includes an attachment portion configured to attach the sheet member to the conveyance member, and the protruded portions are protrusions different from the attachment portion.

14. The developer container according to claim 13, wherein a rotation radius of each of the protruded portions is larger than a rotation radius of the attachment portion.

15. The developer container according to claim 11, wherein the developer container includes an opening, wherein the sheet member seals the opening, and wherein, as the conveyance member moves, the sheet member is peeled off from the developer container, thereby revealing the opening.

16. The developer container according to claim 15, wherein the ends of the protruded portions respectively pass through the holes before peeling of the sheet member from the developer container starts, and the peeling of the sheet member starts thereafter.

17. The developer container according to claim 11, wherein each of the ends of the protruded portions has an inclined surface located on an upstream side in a direction of rotation of the conveyance member.

18. The developer container according to claim 11, wherein, in a case where the sheet member is a first sheet member, the developer container further comprises a second sheet member configured to convey the developer, and wherein a length of the second sheet member in a transverse direction thereof is shorter than a length of the first sheet member in a transverse direction thereof.

19. The developer container according to claim 18, wherein the second sheet member is arranged in such a manner that the second sheet member does not cover the holes in the first sheet member.

20. A developing device comprising:

the developer container according to claim 1; and a developer carrying member that carries developer.

21. A process cartridge comprising:

the developer container according to claim 1;

a developer carrying member that carries developer; and an image bearing member that bears a developer image.

22. An image forming apparatus comprising:

the developer container according to claim 1;

a developer carrying member that carries developer; and an image bearing member that bears a developer image, wherein the image forming apparatus forms an image on a recording material.

* * * * *